US005983542A

United States Patent [19]

Chen

[11] Patent Number: 5,983,542

[45] Date of Patent: Nov. 16, 1999

[54] TRANSMISSION STRUCTURE OF A DECORATIVE TREE

[76] Inventor: Li-Ching Chen, P.O. Box 82-144, Taipei, Taiwan

[21] Appl. No.: 09/071,985

[22] Filed: May 5, 1998

[51] Int. Cl.[6] ..... G09F 19/08

[52] U.S. Cl. ..... 40/411; 40/416; 446/301

[58] Field of Search ..... 40/411, 416, 429; 446/297, 298, 301, 337, 342; 74/48, 104, 665 G, 96

[56] References Cited

U.S. PATENT DOCUMENTS

| | | | |
|---|---|---|---|
| 1,292,105 | 1/1919 | Shoenberg | 40/416 X |
| 2,442,586 | 6/1948 | Clark . | |
| 3,835,561 | 9/1974 | Camerino | 40/416 |
| 4,850,930 | 7/1989 | Sato et al. | 446/301 X |
| 4,900,289 | 2/1990 | May et al. | 446/301 X |
| 5,074,821 | 12/1991 | McKeefery et al. | 40/416 X |
| 5,108,341 | 4/1992 | DeSmet | 446/301 X |
| 5,413,516 | 5/1995 | Lam | 446/301 |
| 5,415,579 | 5/1995 | Pracas | 446/301 X |

*Primary Examiner*—Joanne Silbermann
*Attorney, Agent, or Firm*—A & J

[57] ABSTRACT

A decorative tree includes a trunk and a transmission structure fixedly mounted the trunk and including a pair of eyeballs, a pair of eyelids, a mouth plate and an electric motor. The transmission structure can make the decorative tree blink eyes and move mouth as desired thereby making the decorative tree look very interesting.

2 Claims, 5 Drawing Sheets

TRANSMISSION STRUCTURE OF A DECORATIVE TREE

BACKGROUND OF THE INVENTION

1. Field of the Invention

This invention is related to a transmission structure of a decorative tree and in particular to one which can make the decorative tree look more interesting.

2. Description of the Prior Art

It has been found that the conventional decorative tree can be used for decoration only and has no other functions. Furthermore, the conventional decorative tree looks dull and monotonous in appearance thereby making it very difficult to attract one's buying desire.

Therefore, it is an object of the present invention to provide a transmission structure which can make a decorative tree blink eyes and open mouth as desired thereby causing the tree to look very interesting.

SUMMARY OF THE INVENTION

This invention is related to an improved transmission structure of a decorative tree.

It is the primary object of the present invention to provide a transmission structure which can make a decorative tree blink eyes and move the mouth as desired.

It is another object of the present invention to provide a transmission structure which can make a decorative tree look very interesting.

It is still another object of the present invention to provide a transmission structure which is easy to manufacture.

It is still another object of the present invention to provide a transmission structure which is low in cost.

It is a further object of the present invention to provide a transmission structure which is facile to assemble.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
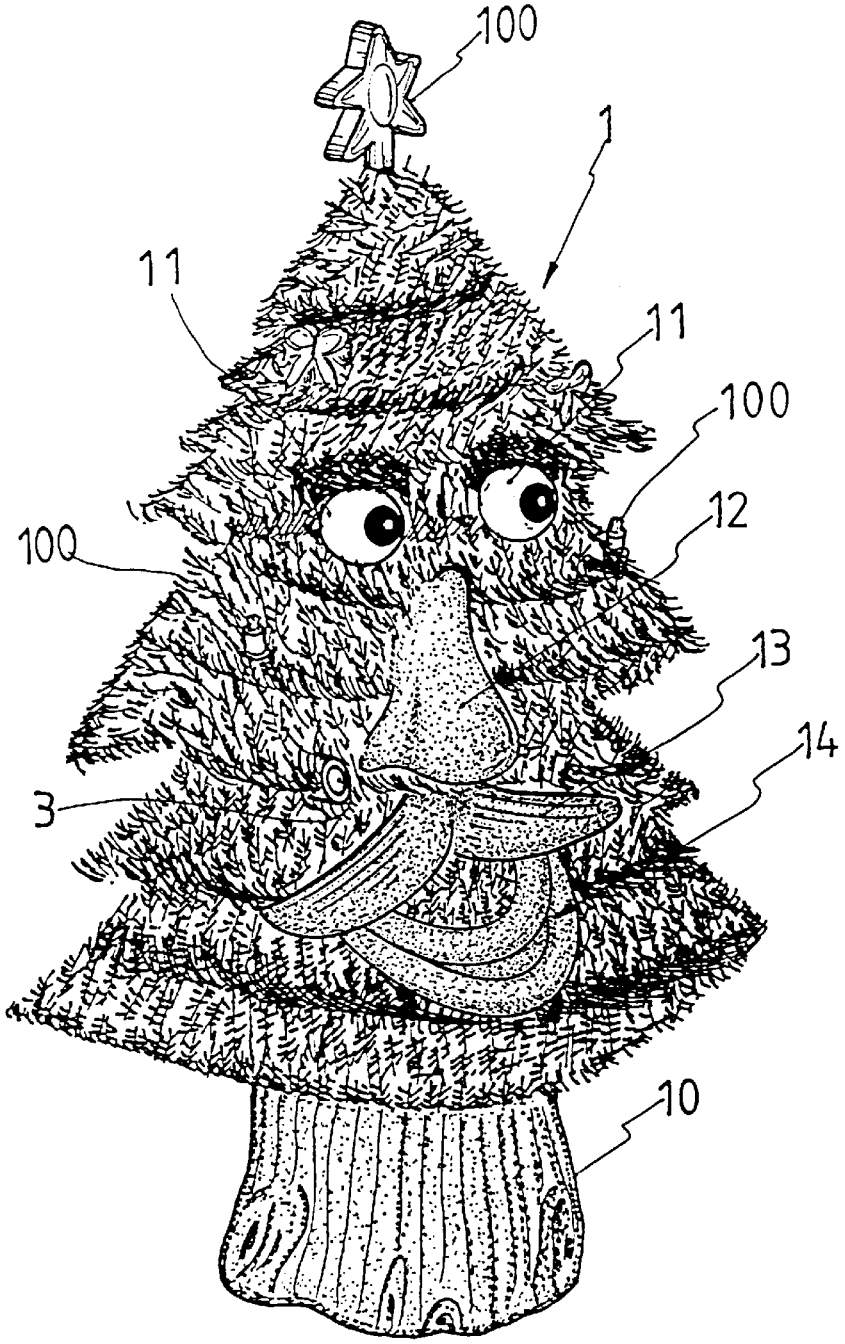
FIG. 1 illustrates a Christmas tree equipped with a transmission structure according to the present invention.

For the purpose-of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
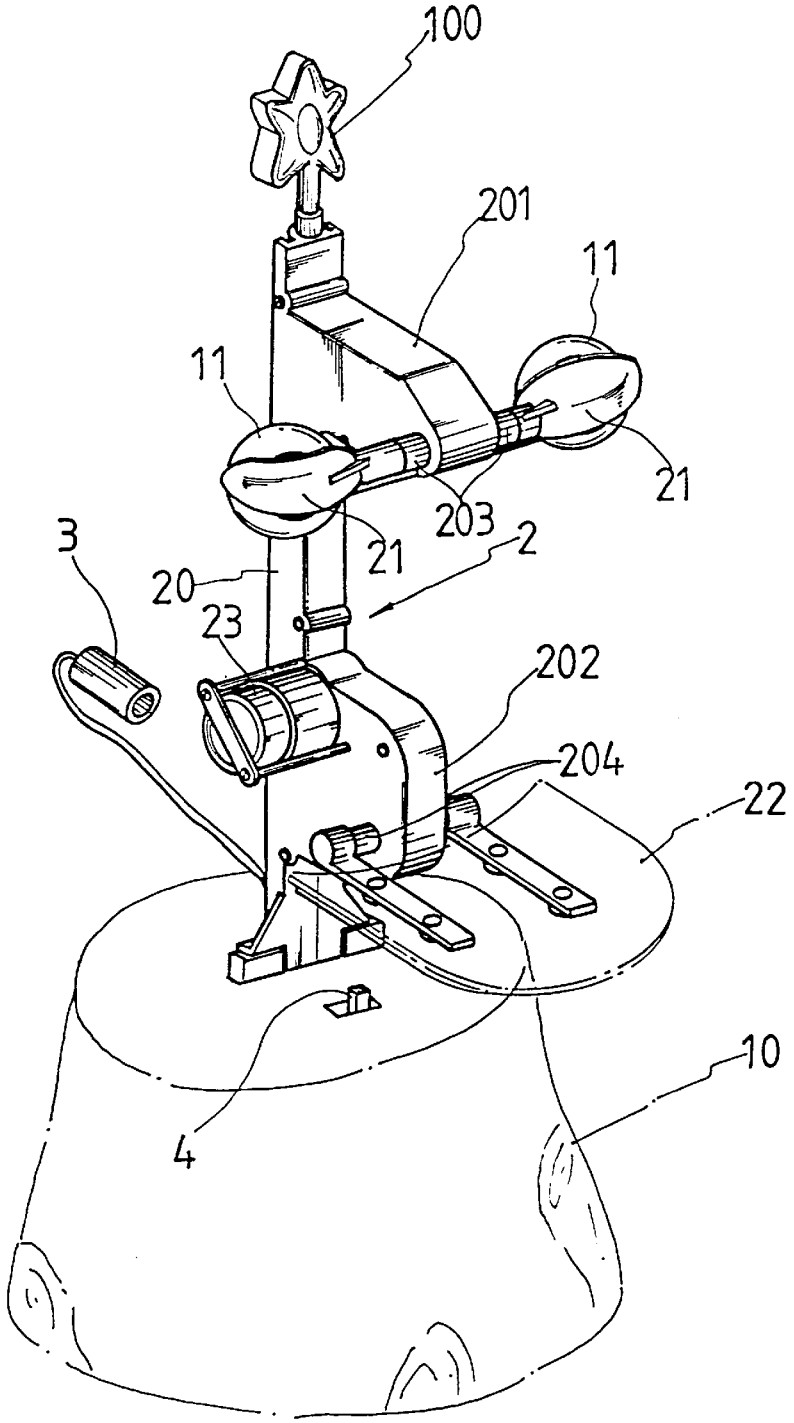
FIG. 2 is a perspective view of the transmission structure according to the present invention.
Figure 3:
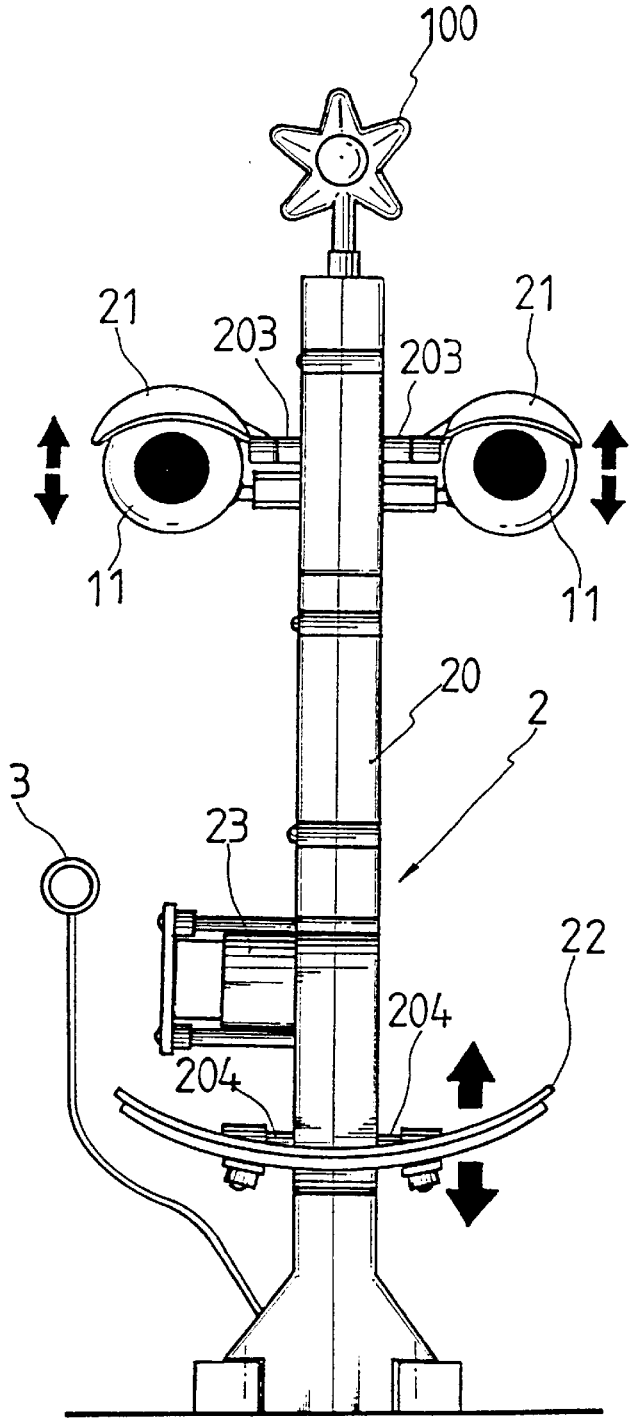
FIG. 3 is a working view of the present invention.

With reference to the drawings and in particular to FIGS. 1 and 2 thereof, the Christmas tree according to the present invention generally comprises a trunk 10, a transmission structure 2, a sensor 3 and an electrical switch 4. The transmission structure 2, the sensor 3 and the electrical switch 4 are fixedly mounted on the trunk 10 and covered with leaves of the tree. As the sensor 3 picks up a signal, a music reproducing device (not shown) and the transmission structure 2 will be turned on to blink the eyeballs 11, move the mouth 14 and illuminate the light 100 according to the beats of the music produced by the music reproducing device.

Figure 4:
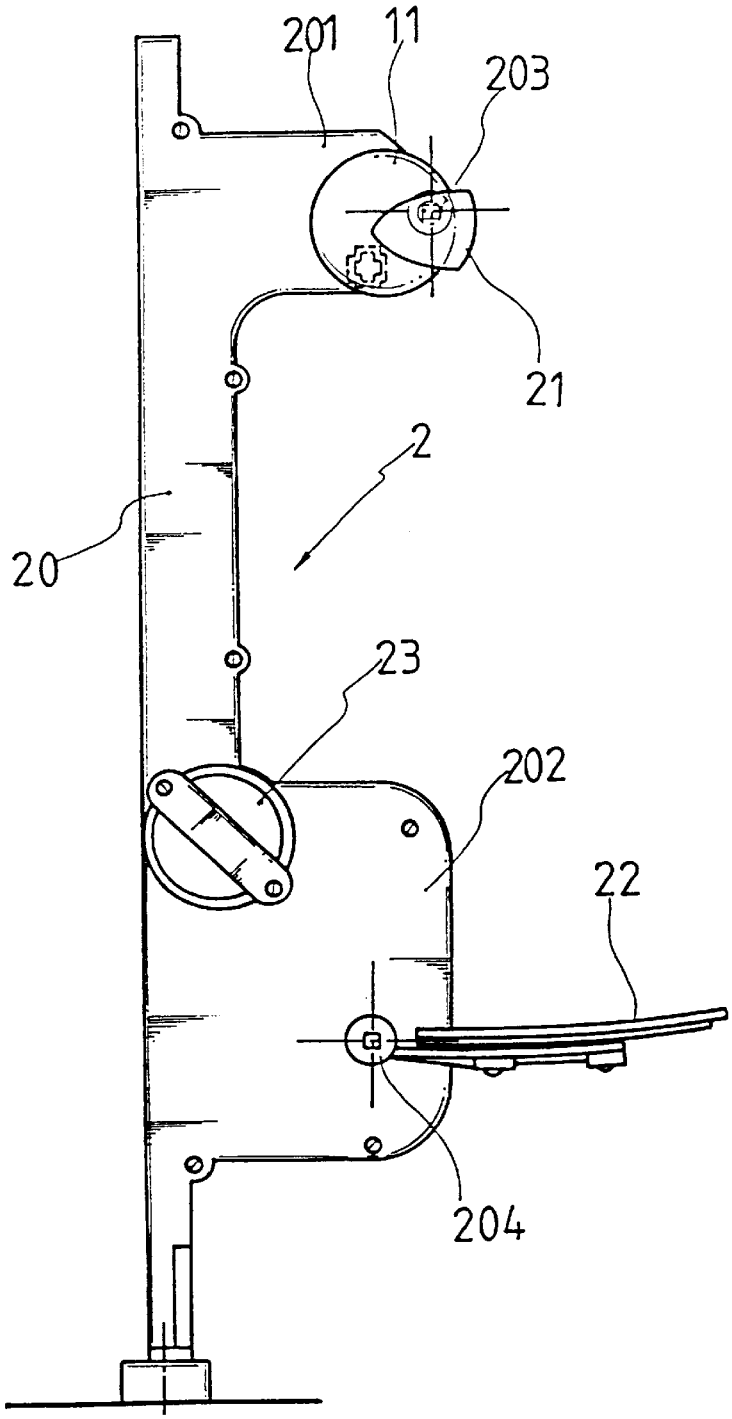
FIG. 4 is a side view of the present invention.

Referring to FIGS. 1, 2, 3 and 5, the transmission structure 2 includes a body portion 20, a pair of eyeballs 11, a pair of eyelids 21, a mouth plate 22, an electric motor 23, a driving gear 231, a medium gear 24, a driven gear 25, a L-shaped link 26, a pull rod 27, an oscillating rod 28 and a rocking rod 29. The body portion 20 is an elongated member formed with an upper arm 201 and a lower arm 202 (see FIG. 4).

The eyeballs 11 are fixedly mounted on both sides of the upper arm 201 of the body portion 20. A first axle 203 extends through the upper arm 201 of the body portion 20 to engage with the two eyelids 21 at two ends thereof so that the eyelids 21 can be rotated with respect to the eyeballs 11. A second axle 204 extends through the lower arm 202 of the body portion 20 to engage with the mouth plate 22. When the sensor 3 picks up a signal, the driving structure 2 will be actuated to move the eyelids 21 and the mouth plate 24 synchonorously. As the eyelids 21 are moved up and down, the tree will look like blinking. The electric motor 23 is fastened on one side of the lower arm 202 of the body portion 20.

Figure 5:
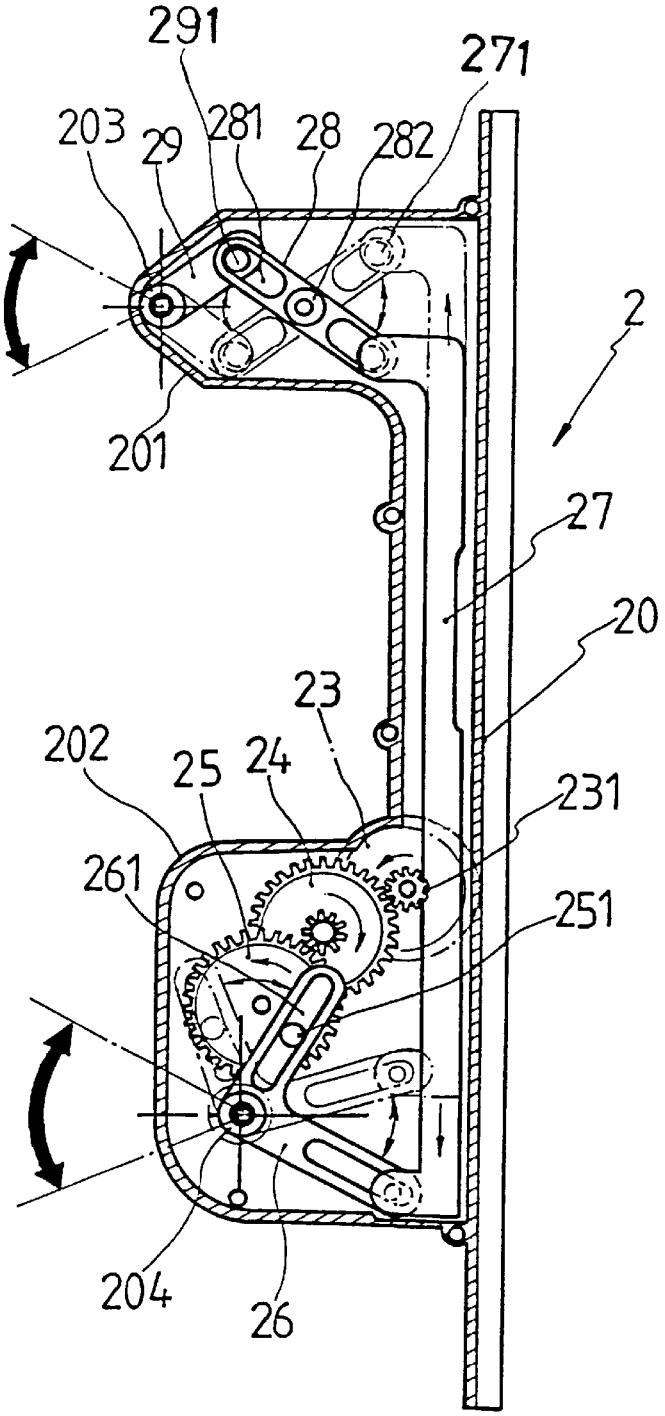
FIG. 5 illustrates the interior of the present invention.

Turning to FIG. 5, the output shaft of the electric motor 23 extends into the body portion 20 to fixedly engage with a driving gear 231. The driving gear 231 is meshed with a medium gear 24 which is in turn meshed with a driven gear 25. The L-shaped link 26 is pivotally mounted connected with the second axle 204 and formed with a slot 261 at both arms thereof. The driven gear 25 is provided with an eccentric pin 251 slidably fitted into a slot 261 of an arm of the L-shaped link 26. The pull rod 27 is provided with a pin 271 at both ends and the pin 271 at the lower end of the pull rod 27 is slidably fitted in a slot 261 of another arm of the L-shaped link 26. The oscillating rod 28 is pivotally mounted within the body portion at the intermediate portion and formed with two slots 281 at both ends thereof and one of the slots 281 is slidably engaged with the pin 271 at the upper end of the pull rod 27. The rocking rod 29 is pivotally mounted on the first axle 203 at an end and provided with a pin 291 at another end slidably fitted into another slot 281 of the oscillating rod 28. When the motor 23 is turned on, the driving gear 231 will rotate the driven gear 25 via the medium gear 24 and the driven gear 25 will move the L-shaped member 26 up and down thereby oscillating the mouth plate 22. In the meantime, the L-shaped member 26 will lift the pull rod 27 up and down thus rotating the oscillating arm 28 up and down, which will in turn move the rocking rod 29 up and down thus oscillating the rocking rod 29 and therefore oscillating the eyelids 21.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A decorative tree comprising:

a trunk; and a transmission structure fixedly mounted on said trunk and including an elongated body portion having an upper arm and a lower arm, a first axle extending through said upper arm, a second axle extending through said lower arm, a pair of eyeballs each fixedly mounted on each end of said upper arm, a pair of eyelids fixedly installed on two ends of said first axle, a mouth plate fixedly installed on said second axle, an electric motor arranged on said elongated body portion, a driving gear fixedly mounted on an output shaft of said motor, a medium gear meshed with said driving gear, a driven gear meshed with said medium gear and provided with an eccentric pin, a L-shaped link pivotally connected with said second axle and having two arms each formed with a slot, said slot of said first arm being slidably engaged with said eccentric pin, a pull rod having an upper end and a lower end slidably engaged with the second arm, an oscillating rod having a first end and a second end, said second end slidably connected with said upper end of said pull rod, and a rocking rod having a first end pivotally connected with said first axle and a second end slidably engaged with said second end of said oscillating rod.

2. The decorative tree as claimed in claim 1, wherein said mouth plate is provided with two lips.

* * * * *